US009581974B2

(12) United States Patent
Roman

(10) Patent No.: US 9,581,974 B2
(45) Date of Patent: Feb. 28, 2017

(54) DIGITAL COLOR CLOCK

(71) Applicant: Systems Design, Inc., Mokena, IL (US)

(72) Inventor: Adam C. Roman, Mokena, IL (US)

( * ) Notice: Subject to any disclaimer, the term of this patent is extended or adjusted under 35 U.S.C. 154(b) by 0 days.

(21) Appl. No.: 14/884,395

(22) Filed: Oct. 15, 2015

(65) Prior Publication Data

US 2016/0033940 A1 Feb. 4, 2016

Related U.S. Application Data

(63) Continuation-in-part of application No. 14/083,119, filed on Nov. 18, 2013, now abandoned.

(51) Int. Cl.

| | |
|---|---|
| ***G04G 9/02*** | (2006.01) |
| ***G04G 9/04*** | (2006.01) |
| ***G04G 9/06*** | (2006.01) |
| ***G04G 9/00*** | (2006.01) |
| ***G04G 9/10*** | (2006.01) |

(52) U.S. Cl.

CPC ..... *G04G 9/045* (2013.01); *G04G 9/0017* (2013.01); *G04G 9/0052* (2013.01); *G04G 9/0082* (2013.01); *G04G 9/02* (2013.01); *G04G 9/04* (2013.01); *G04G 9/06* (2013.01); *G04G 9/105* (2013.01); *G04G 9/0064* (2013.01)

(58) Field of Classification Search

CPC ..... G04G 9/0082; G04G 9/02; G04G 9/04; G04G 9/08; G04G 9/10; G04G 9/0064; G04G 9/045; G04G 9/0017; G04G 9/0052; G04G 9/06; G04G 9/105

USPC ..... 368/82–84, 223, 239–242

See application file for complete search history.

(56) References Cited

U.S. PATENT DOCUMENTS

| | | | | |
|---|---|---|---|---|
| 3,514,938 | A * | 6/1970 | Miller | G04B 45/00 359/213.1 |
| 3,616,643 | A * | 11/1971 | Maue | G04C 17/0075 368/229 |
| 3,702,531 | A * | 11/1972 | Maue | G04B 19/21 368/78 |
| 3,798,892 | A * | 3/1974 | Lukens | G04B 19/34 368/234 |

(Continued)

FOREIGN PATENT DOCUMENTS

| | | | |
|---|---|---|---|
| JP | H2000-098058 | A | 4/2000 |
| WO | 2005/069088 | A1 | 7/2005 |
| WO | 2009/053775 | A1 | 4/2009 |

*Primary Examiner* — Vit W Miska

(74) *Attorney, Agent, or Firm* — Corridor Law Group, P.C.

(57) ABSTRACT

A digital color clock employs six Color Outputs to represent the time of day. A first Color Output represents a tens digit of hours, a second Color Output represents a ones digit of hours, a third Color Output represents a tens digit in minutes, a fourth Color Output represents a ones digit in minutes, a fifth Color Output represents a tens digit in seconds, and a sixth Color Output represents a ones digit in seconds. The digital color clock can optionally display the date, temperature, humidity, and/or barometric pressure using Color Outputs. Front and back light sensors can be included for measuring brightness of ambient light to enable adjustment of Color Outputs in response to changes in brightness of ambient light. In one embodiment, the Color Outputs are interspersed among other unchangeable Color Outputs of a display. The display can be a component of a stationary or hand-held computing device.

14 Claims, 4 Drawing Sheets

(56) References Cited

U.S. PATENT DOCUMENTS 3,854,279 A * 12/1974 Edmunds ..... G04G 9/04 368/234
4,089,156 A * 5/1978 Kashio ..... G04F 10/04 368/112
4,142,362 A * 3/1979 Ebihara ..... G04G 9/087 368/239
4,687,340 A * 8/1987 Havel ..... G04G 21/025 345/159
4,872,150 A * 10/1989 Norman ..... G04B 19/00 368/223
4,926,400 A * 5/1990 Rachofsky ..... G04G 9/0076 368/82
5,228,013 A * 7/1993 Bik ..... G04G 9/02 368/223
5,526,327 A * 6/1996 Cordova, Jr. ..... G04G 9/02 368/223
5,734,625 A * 3/1998 Kondo ..... A61B 5/02438 368/10
5,844,862 A * 12/1998 Cocatre-Zilgien ... A61B 5/0008 368/10
5,863,205 A * 1/1999 Martens ..... G09B 19/12 434/198
6,545,952 B1 * 4/2003 Terzian ..... G04G 9/08 368/112
6,711,101 B2 * 3/2004 Bornovski ..... A44C 15/0015 368/223
6,967,900 B2 * 11/2005 Chapman ..... G01W 1/02 340/539.28
7,079,452 B2 * 7/2006 Harrison ..... G04B 25/00 368/10
7,221,624 B2 * 5/2007 Harrison, Jr. ..... G04B 25/00 368/223
7,362,662 B2 * 4/2008 Lang ..... G04G 9/02 368/228
2007/0171770 A1 * 7/2007 Thompson ..... G04G 9/08 368/82
2008/0165629 A1 * 7/2008 Billeaudeaux ..... G04G 9/02 368/82
2008/0192582 A1 * 8/2008 Spoto ..... G04G 7/00 368/76
2009/0016168 A1 * 1/2009 Smith ..... G04G 9/02 368/10
2009/0201772 A1 * 8/2009 Billeaudeaux ..... G04G 9/02 368/82
2013/0142016 A1 * 6/2013 Pozzo Di Borgo .... G04C 3/002 368/82

* cited by examiner

DIGITAL COLOR CLOCK

CROSS-REFERENCE TO RELATED APPLICATION(S)

This application is a continuation-in-part of U.S. patent application Ser. No. 14/083,119 filed on Nov. 18, 2013, entitled "Digital Color Clock".

FIELD OF THE INVENTION

The present invention relates to the use of color output to represent numerical digits in applications involving dynamic digital displays. One embodiment involves use of such color representations in a digital clock with a panel displaying six Color Outputs, each of which displays a unique color corresponding to, in the embodiment of a clock, each digit of hours, minutes and seconds. In other embodiments, dynamic numeric information such as date, temperature, humidity and/or barometric pressure, can be displayed, where each of ten specific colors represents a single decimal digit, namely, zero through nine (0-9).

BACKGROUND OF THE INVENTION

Man has been using devices to keep time from at least as early as the $16^{th}$ century B.C. These earliest devices were simple water clocks with the first mechanical clocks appearing in $13^{th}$ century Europe. The first mechanical clocks did not have a visual indicator of the time, but instead signaled the time audibly via bells. Over the centuries, a visual indicator was added in the form of a clock face, which eventually evolved into the traditional twelve-hour face used on many analog clocks. With advancements in technology, digital clocks that display the time in readable digits became prevalent in the 1960s and have steadily been replacing analog clocks. In fact, most individuals today are familiar with digital clocks, and many find them much easier to use than analog clocks.

Common among most clocks, either digital or analog, is their reliance on either Roman or Arabic numbers to indicate the time. Some clocks, such as the one described in U.S. Pat. No. 5,228,013, have abandoned the use of Roman or Arabic numbers. These clocks instead use a complex pattern of flashing lights integrated in a piece of art. While this design is creative, it is not easily identifiable to an uninitiated observer as a clock. Furthermore, even if an individual is aware that the device is a clock and is trained to use it, he/she must still wait for the clock to go through its complex pattern of flashing lights, to discern the time. A clock that does not use Roman and Arabic numbers, but still displays the time in a customary 12-hour or 24-hour format, would be desirable to provide entertainment along with a useful display of the time of day. One such customary format is the one commonly used with digital clocks, namely, $[h_1h_2]$: $[m_1m_2]$·$[s_1s_2]$, where:

- $h_1$=tens digits of the hour being displayed, in units of 0 through 2;
- $h_2$=ones digits of the hour being displayed, in units of 0 through 9;
- $m_1$=tens digits of the minutes being displayed, in units of 0 through 5;
- $m_2$=ones digits of the minutes being displayed, in units of 0 through 9;
- $s_1$=tens digits of the seconds being displayed, in units of 0 through 5; and

- $s_2$=ones digits of the seconds being displayed, in units of 0 through 9.

SUMMARY OF THE INVENTION

A digital color clock for displaying time of day comprises:

(a) a housing comprising a front face;

(b) a controller capable of generating time-keeping signals comprising an hours signal, a minutes signal and a seconds signal; and (c) a time display comprising six illuminated Color Outputs on the housing front face, a first of the Color Outputs receiving the hours signal to display a color representing a tens digit of hours, a second of the Color Outputs receiving the hours signal to display a color representing a ones digit of hours, a third of the Color Outputs receiving the minutes signal to display a color representing a tens digit in minutes, a fourth of the Color Outputs receiving the minutes signal to display a color representing a ones digit in minutes, a fifth of the Color Outputs receiving the seconds signal to display a color representing a tens digit in seconds, and a sixth of the Color Outputs receiving the seconds signal to display a color representing a ones digit in seconds.

In one embodiment, the digital color clock can further comprise:

(d) a controller capable of generating a date signal comprising a day signal, a month signal and a year signal; and (e) a date display comprising six illuminated date Color Outputs located on the housing front face, a first of the date Color Outputs receiving the day signal to display a color representing a tens digit of the day in the date, a second of the date Color Outputs receiving the day signal to display a color representing a ones digit of the day in the date, a third of the date Color Outputs receiving the month signal to display a color representing a tens digit of the month in the date, a fourth of the date Color Outputs receiving the month signal to display a color representing a ones digit of the month in the date, a fifth of the date Color Outputs receiving the year signal to display a color representing a tens digit of the year in the date, a sixth of the date Color Outputs receiving the year signal to display a color representing a ones digit of the year in the date.

In another embodiment, the digital color clock can further comprise:

(d) a controller capable of generating a temperature signal; and (e) a temperature display comprising four illuminated temperature Color Outputs located on the housing front face, a first of the temperature Color Outputs receiving the temperature signal to display a color representing a hundreds digit in temperature, a second of the temperature Color Outputs receiving the temperature signal to display a color representing a tens digit in temperature, a third of the temperature Color Outputs receiving the temperature signal to display a color representing a ones digit in temperature, and a fourth of the temperature Color Outputs receiving the temperature signal to display a color representing a tenths digit in temperature.

In another embodiment, the digital color clock can further comprise a minus symbol, the minus symbol capable of illumination when the temperature signal is indicative of a temperature below zero.

In another embodiment, the digital color clock can further comprise:

(d) a controller capable of generating a humidity signal; and (e) a humidity display comprising four illuminated humidity Color Outputs located on the housing front face, a first of the humidity Color Outputs receiving the humidity signal to display a color representing a hundreds digit in humidity, a second of the humidity Color Outputs receiving the humidity signal to display a color representing a tens digit in humidity, a third of the humidity Color Outputs receiving the humidity signal to display a color representing a ones digit in humidity, and a fourth of the humidity Color Outputs receiving the humidity signal to display a color representing a tenths digit in humidity.

In another embodiment, the digital color clock can further comprise:

(d) a controller capable of generating a barometric pressure signal; and (e) a barometric pressure display comprising four illuminated barometric pressure Color Outputs located on the housing front face, a first of the barometric pressure Color Outputs receiving the barometric pressure signal to display a color representing a hundreds digit in barometric pressure, a second of the barometric pressure Color Outputs receiving the barometric pressure signal to display a color representing a tens digit in barometric pressure, a third of the barometric pressure Color Outputs receiving the barometric pressure signal to display a color representing a ones digit in barometric pressure, and a fourth of the barometric pressure Color Outputs receiving the barometric pressure signal to display a color representing a tenths digit in barometric pressure.

The housing can further comprise a front light sensor for measuring brightness of ambient light at a position in front of the housing front face and a back light sensor for measuring brightness of ambient light at a position behind the housing front face. The front and back light sensors are capable of generating and transmitting brightness signals to the controller. The controller, in turn, is capable of adjusting the Color Outputs in response to changes in brightness of ambient light.

In another embodiment, the first and second Color Outputs are located adjacent to one another to form an hours pair. The third and fourth Color Outputs are located adjacent to one another to form a minutes pair. The fifth and sixth Color Outputs are located adjacent to one another to form a seconds pair. The housing front face further comprises:

(i) a first separator interposed between the hours pair and the minutes pair, (ii) a second separator interposed between minutes pair and the seconds pair.

The first and second separators can be illuminated. The first separator is typically a colon and the second separator is typically a period.

In some embodiments, each of the Color Outputs comprises red-green-blue light-emitting diodes. In some other embodiments, each of the Color Outputs comprises red-green-blue liquid crystal displays (LCDs).

In some embodiments, the front face has a plurality of unchangeable colored sections and the Color Outputs are interspersed among the unchangeable colored sections. The housing front face can be a display for a stationary or hand-held computing device.

A method of displaying time of day comprises:

displaying six illuminated Color Outputs on a display, a first of the Color Outputs receiving the hours signal to display a color representing a tens digit of hours, a second of the Color Outputs receiving the hours signal to display a color representing a ones digit of hours, a third of the Color Outputs receiving the minutes signal to display a color representing a tens digit in minutes, a fourth of the Color Outputs receiving the minutes signal to display a color representing a ones digit in minutes, a fifth of the Color Outputs receiving the seconds signal to display a color representing a tens digit in seconds, and a sixth of the Color Outputs receiving the seconds signal to display a color representing a ones digit in seconds.

The forgoing method can further comprise interspersing each of the Color Outputs among a plurality of unchangeable portions of the display.

A method of telling time comprises:

(a) perceiving six illuminated Color Outputs on a display;

(b) recognizing that a first of the Color Outputs represents a tens digit of hours, a second of the Color Outputs represents a ones digit of hours, a third of the Color Outputs represents a tens digit in minutes, a fourth of the Color Outputs represents a ones digit in minutes, a fifth of the Color Outputs represents a tens digit in seconds, and a sixth of the Color Outputs represents a ones digit in seconds.

In the foregoing method, the Color Outputs can be interspersed among a plurality of unchangeable portions of the display. The display can be a component of a stationary or hand-held computing device.

DETAILED DESCRIPTION OF ILLUSTRATIVE EMBODIMENT(S)

Figure 1:
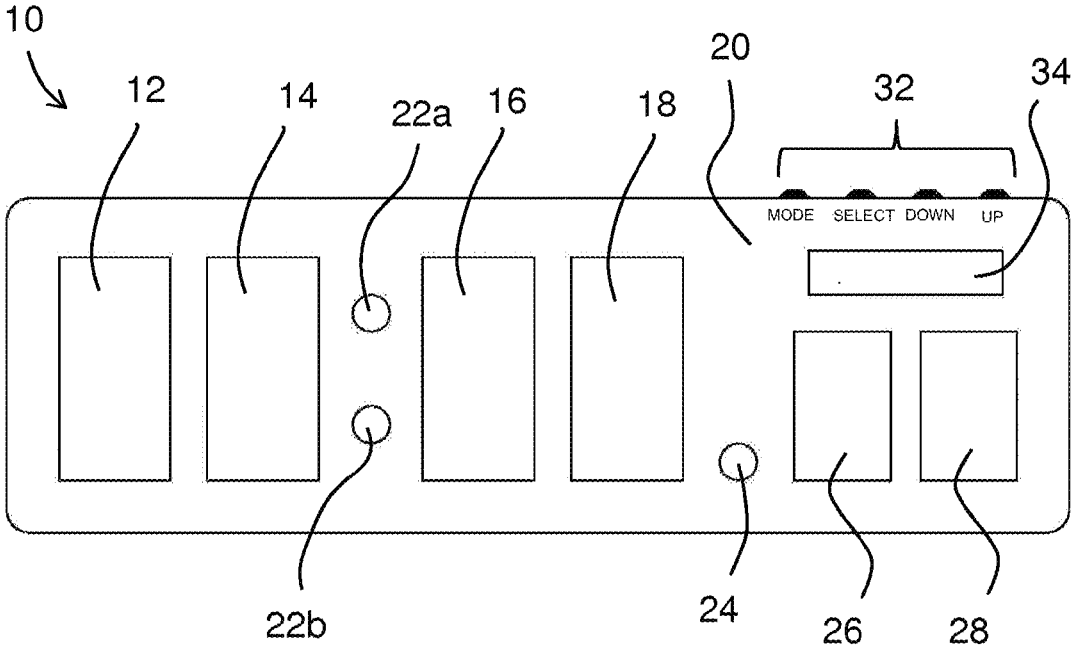
FIG. 1 is a front view of a the digital color clock which employs uniformly Color Outputs to represent, from left to right, hours, minutes and seconds.
Figure 2:
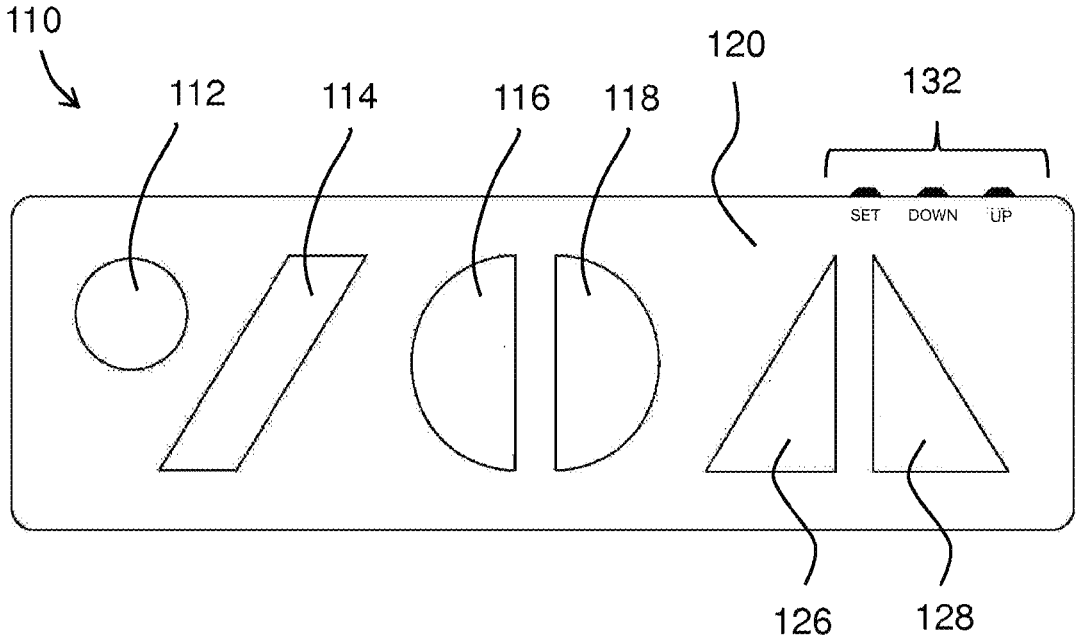
FIG. 2 is a front view of a digital color clock, employing uniquely shaped Color Outputs to represent, from left to right, hours, minutes and seconds.
Figure 3:
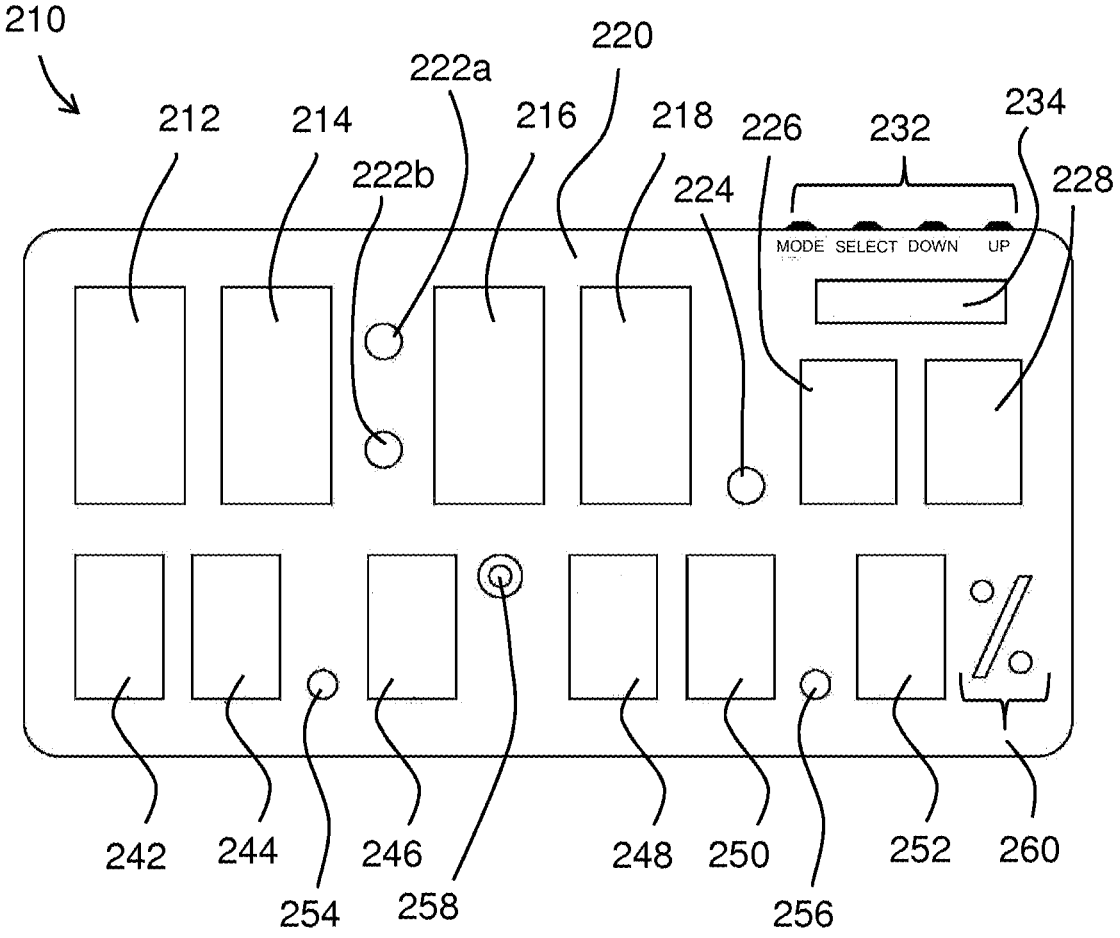
FIG. 3 is a front view of a digital color clock that employs Color Outputs to represent the time (top row of six Color Outputs), temperature (bottom left group of three Color Outputs) and humidity (bottom right group of three Color Outputs).

FIGS. 1, 2 and 3 illustrate various examples of a digital color clock.

FIG. 1 is a basic unit of a digital color clock 10. The main panel of housing 20 includes six Color Outputs for the tens digits of the hour 12, the ones digits of the hour 14, tens digits of the minute 16, the ones digits of the minute 18, tens digits of the second 26, and the ones of the second 28. The display uses a colon 22*a*, 22*b* and a period 24 for the unit separators.

For a 12-hour clock, the Color Output for the tens digits of the hour 12 shows the first two colors in the code, corresponding to 0 and 1. Likewise, the Color Outputs for the tens digits of minute 16 and the tens digits of the second 26 show the first six colors in the code, corresponding to 0 through 5. The rest of the Color Outputs show all ten colors in the code, corresponding to 0 through 9.

For a 24-hour clock, the Color Output for the tens digits of the hour 12 shows the first three colors in the code, corresponding to 0, 1 and 2. The Color Outputs for the minutes and seconds would remain the same as those of the 12-hour clock described above.

The basic unit includes an optional LCD panel 34 and a collection of buttons 32, which can be used to set the time or an alarm, among other functions.

FIG. 2 is digital color clock utilizing various shapes for the Color Outputs 110. Its main panel 120 includes six Color Outputs for the tens digits of the hour 112, the ones digits of the hour 114, tens digits of the minute 116, the ones digits of the minute 118, tens digits of the second 126, and the ones of the second 128. It does not contain a unit separator but does contain a collection of buttons 132, which can be used to set the time or an alarm, among other functions FIG. 3 is an advanced digital color clock 210 with a front panel 220 utilizing six Color Outputs for the tens digits of the hour 212, the ones digits of the hour 214, tens digits of the minute 216, the ones digits of the minute 218, tens digits of the second 226, and the ones of the second 228.

The advanced digital color clock 210 also contains three Color Outputs for the temperature, one for the tens digit of the temperature 242, one for the ones digits of temperature 244, and one for the tenths digits of temperature 246. This embodiment employing three Color Outputs as described would be suited to indoor temperature readings in Fahrenheit units. If the outside temperature were to be displayed, then the digital color clock would contain four Color Outputs, one for the hundreds digit of the temperature, one for the tens digit of the temperature, one for the ones digits of temperature, and one for the tenths digits of temperature. There would also be a Color Output to display a minus sign when the outside temperature is below zero.

The advanced digital color clock 210 further contains three Color Outputs for the humidity. One for the tens digits of the humidity 248, one for the ones digits of humidity 250, and one for the tenths digit of humidity 252.

In addition, FIG. 3 contains two decimal points, namely, decimal point 254 located between the ones digit of the temperature and the tenths digit of the temperature, and decimal point 256 located between the ones digit of the humidity and the tenths digit of the humidity. FIG. 3 also contains two mathematical symbols, namely, degree symbol 258 for the three preceding Color Outputs for temperature and percentage symbol 260 for the three preceding Color Outputs for humidity.

Finally FIG. 3 illustrates an optional LCD panel 234 and a collection of buttons 232, which can be used to set the time or an alarm, among other functions.

Figure 4:
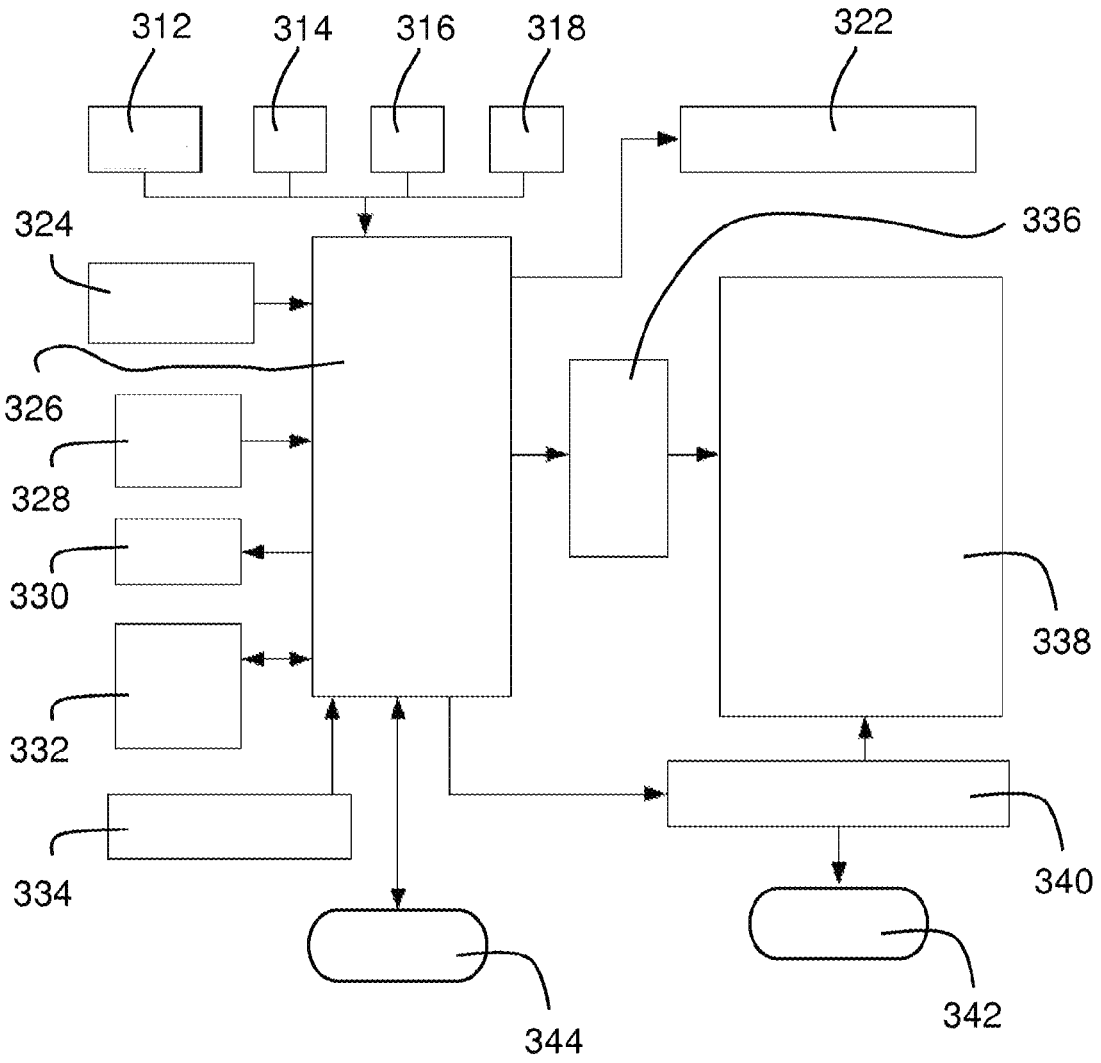
FIG. 4 is schematic diagram of the digital color clock showing its modules and constituent components.

Turning to FIG. 4, an 8-bit microcontroller 326 running custom firmware code performs time-keeping functions, reading of buttons 334 for setting time and display modes, monitoring of ambient lighting conditions from a front light sensor 314 and a top or back light sensor 316 for automatic color and brightness adjustment, and other optional functions such as reading a temperature and/or humidity sensor 312, receiving information from a weather receiver 318 configured to receiver data from a remote weather station or displaying data on an optional LCD panel 322. The microprocessor produces a multiplexed pulse-width-modulated output, which feeds power output 336 for driving 40 red-green-blue light-emitting diodes (RGB LEDs) and 8 single-color LEDs 338, each capable of displaying 42-bit resolution (over 4 trillion colors). This robust color-depth capability allows the device to display its ten-digit colors over a large range of ambient lighting conditions. A 16-channel constant-current PWM LED driver 340, is used to adjust the LED color. Additional drivers 342, may be utilized to increase the numbers of LEDs being used, although this would decrease the number of shades that could be used by any single LED.

Figure 5:
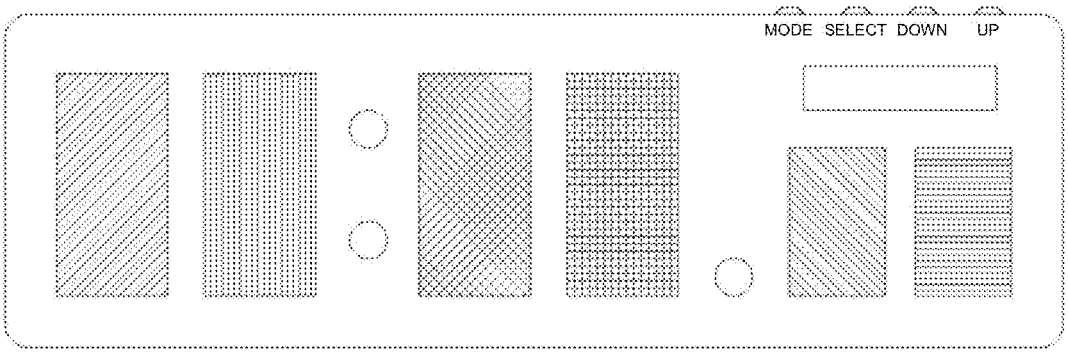
FIG. 5 is a front view of a digital color clock embodiment with its Color Outputs displaying a time of day of 12:34.56.

FIG. 5 shows a digital color clock embodiment with its Color Outputs displaying a time of day of 12:34.56. An optional LED or LCD panel is located between the Color Outputs displaying the 56 seconds of the time of day and the labels for the buttons at the top edge of the clock's front face. The optional LED/LCD panel could be used as a standard numeric digital time display or for advanced features, such as the setting of alarm(s) or color code customization.

As an option, additional outputs for displaying other temporal information, such as year, month, day, temperature, barometric pressure and humidity can also be provided. Additional LED outputs can also support LEDs for displaying the colon symbol traditionally used to separate hours, minutes and seconds. Additional LEDs can also be used to illuminate the case or frame for the clock.

The clock can also act as a slave to another host processor 344. In this embodiment, the clock would simply display the numbers received by host processor 344. For example, the host processor might be running a program that counts down until a child's birthday. In this embodiment, the clock would display the digits being fed to it from the host processor as Color Outputs.

Color and brightness uniformity of each Color Output are important for correct, unambiguous identification of the 10 colors. Several techniques are employed to evenly illuminate each Color Output. Each RGB LED or LCD (which can be a "bank" of many individual red, green and blue LEDs or LCDs) illuminates a Color Output from the side or rear, tailored for high contrast and uniform light output and mixing of the individual red, green and blue LEDs or LCDs.

Techniques similar to those employed in edge-lit backlights for high-quality color LCD panels in television and computer monitors can also be employed in the present digital color clock.

The present digital color clock can adapt to the changing lighting conditions of the environment in which the device resides (to which the user's eyes also adjust with respect to brightness and white-balance), thus making the Color Outputs accurately readable in a wide range of ambient conditions. Two light sensors (typically digital RGB ambient light sensors or simply analog phototransistors with color filters) can be incorporated to scale the brightness and hue of the ten digital colors generated by the LEDs or LCDs.

An algorithm in the microcontroller's firmware can slightly adjust the LED color code's overall hue to adjust for varying environmental white balance by integrating light sensor data. The algorithm can incorporate digital low-pass filters so these adjustments to brightness and hue occur with a similar speed as the human eye, making these changes transparent to the user.

To increase its functionality, the present digital color clock can contain an infrared LED and receiver 332 for remote control use, an alarm amplifier and speaker 330, a microphone for automatic adjustment of alarm volume 328, a weather receiver configured to receive data from a weather station 318, and/or an atomic clock data radio receiver 324.

In one embodiment, the present digital color clock contains a sequence of Light Color Outputs that can display multiple colors depending on the inputs to the LED's through the circuit hardware and firmware that controls the LED sequence for all LED's. In one example, the circuit hardware and firmware controls the LED output colors in a six sequential LED display including a time of day made visible in hours, minutes, and seconds. Time can be displayed in 12 hour or 24 hour outputs. Optional outputs and applications include but are not limited to temporal information such as year, month, day, temperature and humidity.

Instead of the traditional format of displaying standard numerals on a 7-segment or graphic dot-matrix display (or digital representation of a standard analog clock), the present clock has a panel which displays its digits, 0-9, as specific, unique colors. In one embodiment, the ten specific color outputs are as follows:

| Digit | Color |
|---|---|
| 0 | Black |
| 1 | Brown |
| 2 | Red |
| 3 | Orange |
| 4 | Yellow |
| 5 | Green |
| 6 | Blue |
| 7 | Purple |
| 8 | Gray |
| 9 | White |

In the foregoing embodiment, the colors correspond to the standard color codes for resistors and other electronic components, which were developed in the early 1920s by the Radio Manufacturers Association. The current international standard is IEC 60062 published by International Electrotechnical Commission. (See https://en.wikipedia.org/wiki/Electronic_color_code, accessed on Oct. 4, 2015.)

Each color displayed represents, in accordance with a standard or custom color code, the specific digits of the hour, minutes and seconds of the current clock time. Upon learning the color code, a user can tell the time. The Color Outputs need not be any specific size or shape, though specific tailoring can be of some advantage to visibility across a distance. Nor need the Color Outputs be the same size or shape of each other. For example, the Color Outputs representing the hours and minutes could be large circles, while the Color Outputs representing the seconds could be small squares.

In one example, the clock uses six Color Outputs to report the time. Two Color Outputs are used to represent hours, two for minutes, and two for seconds.

In addition to the six horizontally-arranged Color Outputs, the panel can contain unit separators. The most common unit separators would be a colon between the hours and minutes Color Outputs and a period between the minutes and seconds Color Outputs. The unit separators may also be illuminated but preferably not in a color used by the Color Outputs. The separators act as additional indicators of the clock's function and make it easier to read the time.

In another embodiment, the unit separators may be other symbols. These symbols make it harder to tell that the device is a clock, but still serve as a reference point for one who is aware they are looking at a clock and make it easier to read the time displayed by the Color Outputs.

Both the separators and the Color Outputs can be illuminated using red/green/blue light-emitting diodes. In one embodiment, the Color Outputs and separators are surrounded by other unchanging light-emitting diodes.

The digital color clock can also include an alarm, temperature, humidity and optical sensors, atomic clock data radio receiver, and an infrared receiver for remote control operation. Preferably, the digital color clock will also include ambient light sensors to facilitate accurate reproduction of the colors involved.

Replacing digits with colors can help persons with learning disabilities to tell time by reading ten unique colors corresponding to ten unique digits. It is also useful for those with vision problems, as in certain situations it is easier to differentiate between the Color Outputs than attempt to read actual numbers. A flicker or sparkle effect could be applied to certain colors (instead of using static colors for every digit) to make the device equally useful by the partially colorblind.

In one embodiment learning the color code is fairly simple and can be accomplished by watching the repeating pattern of the Color Outputs, specifically those related to seconds.

The logic required by a user to decipher the code and timing of the associated learning curves could be employed to measure the acuity and capabilities of the human brain, making the clock useful in Intelligence Quotient measurement or for evaluating mental health conditions.

To further aid in reading the clock, a color code decoding table or "cheat sheet" can scroll across on optional LCD screen. In one embodiment the cheat sheet could scroll the code, "0=Black, 1=Brown, 2=Red, 3=Orange . . . . " In another embodiment, the cheat sheet could actually display the time in digital format, making it easier for the user to decipher the code.

The use of Color Outputs in place of Arabic or Roman numerals is not limited to a physical clock. The Color Outputs may also be used in a clock on a smartphone, tablet, computer, and the like. The color output could also be used as an alternative in other common numeric display devices such as calculators, alarm panels and multi-meters that measure current, voltage and resistance.

In the present digital color clock, the depth of color of each Color Output, which can display one of a multitude of colors, can be adjusted to the environment in which the clock is displayed. In this regard, the hues of the Color Outputs can be modified based upon the ambient background lighting and colors present in the environment surrounding the clock. For example, front and back light sensors can be employed to measure the brightness of the surrounding environment and provide signals to the processor to dim and brighten the Color Outputs as desired.

The present digital color clock has been shown as implemented in a stand-alone unit (see FIG. 3). The clock can also be implemented on the display of most any computer devices, such as the screen of a smart device, such as a tablet or watch, the screen of a laptop computer, or the monitor of a desktop computer.

Figure 6:
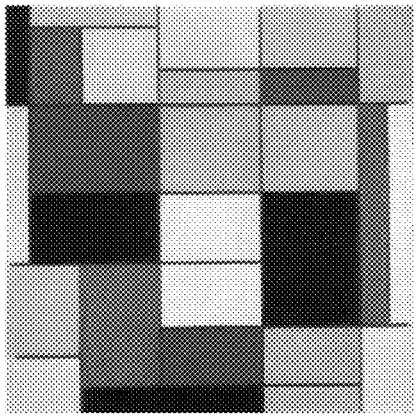
FIG. 6 is a schematic diagram of a digital color clock embodied in a piece of abstract artwork, in which the Color Outputs are interspersed in portions of the artwork, such that the Color Outputs in those portions change as the hours, minutes and seconds of time progress.

The present digital clock can be implemented in embodiments other than a typical horizontally arranged digital clock display. For example, the Color Outputs can be interspersed in portions of artwork, such as that shown in FIG. 6, such that the Color Outputs in those portions change as the hours, minutes and seconds of time progress. Persons observing the artwork will be challenged to discern the significance of each of the changing Color Outputs, eventually recognizing how to tell time from the Color Outputs interspersed in the artwork.

While particular elements, embodiments and applications of the present invention have been shown and described, it will be understood that the invention is not limited thereto since modifications can be made without departing from the scope of the present disclosure, particularly in light of the foregoing teachings.

What is claimed is:

1. A digital color clock for displaying time of day comprising:

(a) a housing comprising a front face;

(b) a controller capable of generating time-keeping signals comprising an hours signal, a minutes signal and a seconds signal;

(c) a time display comprising six illuminated Color Outputs on said housing front face, a first of said Color Outputs receiving said hours signal to display a color representing a tens digit of hours, a second of said Color Outputs receiving said hours signal to display a color representing a ones digit of hours, a third of said Color Outputs receiving said minutes signal to display a color representing a tens digit in minutes, a fourth of said Color Outputs receiving said minutes signal to display a color representing a ones digit in minutes, a fifth of said Color Outputs receiving said seconds signal to display a color representing a tens digit in seconds, and a sixth of said Color Outputs receiving said seconds signal to display a color representing a ones digit in seconds, wherein said Color Outputs correspond to preexisting color codes promulgated by an independent authority for depicting an attribute of an electronic component; and (d) a front light sensor located within said housing for measuring brightness of ambient light at a position in front of said housing front face and a back light sensor for measuring brightness of ambient light at a position behind said housing front face, said front and back light sensors capable of generating and transmitting brightness signals to said controller, said controller capable of adjusting said Color Outputs in response to changes in brightness of ambient light, and wherein said housing comprises integrated light sensors to adjust both the brightness and hue of the display color, thereby enhancing accuracy of color reproduction in a plurality of ambient lighting conditions, and wherein said controller comprises low-pass filters to enhance speed of changes in said Color Outputs.

2. The digital color clock of claim 1, further comprising:

(d) a controller capable of generating a date signal comprising a day signal, a month signal and a year signal; and (e) a date display comprising six illuminated date Color Outputs located on said housing front face, a first of said date Color Outputs receiving said day signal to display a color representing a tens digit of the day in said date, a second of said date Color Outputs receiving said day signal to display a color representing a ones digit of the day in said date, a third of said date Color Outputs receiving said month signal to display a color representing a tens digit of the month in said date, a fourth of said date Color Outputs receiving said month signal to display a color representing a ones digit of the month in said date, a fifth of said date Color Outputs receiving said year signal to display a color representing a tens digit of the year in said date, a sixth of said date Color Outputs receiving said year signal to display a color representing a ones digit of the year in said date, wherein said controller is capable of receiving time data wirelessly from an external source.

3. The digital color clock of claim 1, further comprising:

(d) a controller capable of generating a temperature signal; and (e) a temperature display comprising four illuminated temperature Color Outputs located on said housing front face, a first of said temperature Color Outputs receiving said temperature signal to display a color representing a hundreds digit in temperature, a second of said temperature Color Outputs receiving said temperature signal to display a color representing a tens digit in temperature, a third of said temperature Color Outputs receiving said temperature signal to display a color representing a ones digit in temperature, and a fourth of said temperature Color Outputs receiving said temperature signal to display a color representing a tenths digit in temperature, wherein said controller is capable of receiving weather data wirelessly from an external source.

4. The digital clock of claim 3, further comprising a minus symbol, said minus symbol capable of illumination when said temperature signal is indicative of a temperature below zero.

5. The digital color clock of claim 1, further comprising:

(d) a controller capable of generating a humidity signal; and (e) a humidity display comprising four illuminated humidity Color Outputs located on said housing front face, a first of said humidity Color Outputs receiving said humidity signal to display a color representing a hundreds digit in humidity, a second of said humidity Color Outputs receiving said humidity signal to display a color representing a tens digit in humidity, a third of said humidity Color Outputs receiving said humidity signal to display a color representing a ones digit in humidity, and a fourth of said humidity Color Outputs receiving said humidity signal to display a color representing a tenths digit in humidity, wherein said controller is capable of receiving weather data wirelessly from an external source.

6. The digital color clock of claim 1, further comprising:

(d) a controller capable of generating a barometric pressure signal; and (e) a barometric pressure display comprising four illuminated barometric pressure Color Outputs located on said housing front face, a first of said barometric pressure Color Outputs receiving said barometric pressure signal to display a color representing a hundreds digit in barometric pressure, a second of said barometric pressure Color Outputs receiving said barometric pressure signal to display a color representing a tens digit in barometric pressure, a third of said barometric pressure Color Outputs receiving said barometric pressure signal to display a color representing a ones digit in barometric pressure, and a fourth of said barometric pressure Color Outputs receiving said barometric pressure signal to display a color representing a tenths digit in barometric pressure, wherein said controller is capable of receiving weather data wirelessly from an external source.

7. The digital color clock of claim 1, wherein said first and second Color Outputs are located adjacent to one another to form an hours pair, said third and fourth Color Outputs are located adjacent to one another to form a minutes pair, and said fifth and sixth Color Outputs are located adjacent to one another to form a seconds pair, said housing front face further comprising:

(i) a first separator interposed between said hours pair and said minutes pair, and (ii) a second separator interposed between minutes pair and said seconds pair.

8. The digital color clock of claim 7, wherein said first and second separators are illuminated, and wherein said first and second separators are illuminated in a different color than any of said Color Outputs.

9. The digital color clock of claim 7, wherein said first separator is a colon and said second separator is a period.

10. The digital color clock of claim 1, wherein each of said Color Outputs comprises red-green-blue light-emitting diodes, wherein said light-emitting diodes are capable of illumination from the side.

11. The digital color clock of claim 1, wherein each of said Color Outputs comprises red-green-blue liquid crystal displays, wherein said liquid crystal displays are capable of illumination from the side.

12. The digital color clock of claim 1, wherein said housing front face is a display for a stationary or hand-held computing device.

13. The digital color clock of claim 1, wherein each of said Color Outputs comprises red-green-blue light-emitting diodes, wherein said light-emitting diodes are capable of illumination from the rear.

14. The digital color clock of claim 1, wherein each of said Color Outputs comprises red-green-blue liquid crystal displays, wherein said liquid crystal displays are capable of illumination from the rear.

* * * * *